United States Patent [19]

Klotz

[11] 4,439,885

[45] Apr. 3, 1984

[54] SPONGE MOP WITH WRINGER

[76] Inventor: Warren C. Klotz, 29 Huntington Dr., Belleville, Ill. 62223

[21] Appl. No.: 390,357

[22] Filed: Jun. 21, 1982

Related U.S. Application Data

[63] Continuation-in-part of Ser. No. 253,774, Nov. 2, 1982, Pat. No 4,356,586.

[51] Int. Cl.[3] ..... A47L 13/146

[52] U.S. Cl. ..... 15/119 A; 15/244 R

[58] Field of Search ..... 15/116 A, 119 A, 118, 15/244 R, 244 A

[56] References Cited

U.S. PATENT DOCUMENTS

| | | | |
|---|---|---|---|
| 2,221,557 | 11/1940 | Rogers | 15/119 |
| 2,235,264 | 3/1941 | Rogers | 15/119 |
| 3,030,648 | 4/1962 | Greenleaf | 15/119 |

*Primary Examiner*—Edward L. Roberts

*Attorney, Agent, or Firm*—Senniger, Powers, Leavitt and Roedel

[57] ABSTRACT

A mop comprising a handle, a mop head mounted at the front end of the handle for holding a sponge or the like, a wringer for wringing the sponge comprising a squeeze mechanism mounted on the mop head for sliding movement from a retracted position in which it is disposed to permit mopping to an extended position, and for pivotal movement about a pivot axis extending in side-to-side direction with respect to the mop head from the extended position to a wringing position in which the squeeze mechanism squeezes the sponge to wring it, and an actuating mechanism for effecting the aforesaid sliding and pivotal movement of the squeeze mechanism. The actuating mechanism is operated by moving a hand piece mounted on the handle relative to the handle.

12 Claims, 7 Drawing Figures

1
3
5
7
9
11
13
19
21
23
25
27
29
31
37
39
41
43
AX-1

21
23
27
25
3
29
29
31
31
6
6
13
17
11
AX-1

3
23
27
37
43
39
41
35
AX-1
25
3

43
37
39

11
7
19
31
17
31
19
3
5

SPONGE MOP WITH WRINGER

CROSS-REFERENCE TO RELATED APPLICATION

This is a continuation-in-part of my pending application Ser. No. 253,774, issued as U.S. Pat. No. 4,356,586 on Nov. 2, 1982.

BACKGROUND OF THE INVENTION

This invention relates generally to sponge mops, and more particularly to a sponge mop having a wringer of the type described in my pending application Ser. No. 253,774.

The wringer described in my pending application generally comprises a squeeze plate mounted on the mop head, a lever arm projecting rearwardly from the mop head along the mop handle, and means for mounting the squeeze plate on the mop head for sliding movement of the squeeze plate from a retracted position in which it is disposed to permit mopping, to an extended position, and for pivotal movement of the squeeze plate about an axis extending in side-to-side direction with respect to the mop head from the extended position to a wringing position in which the squeeze plate squeezes the sponge to wring it out.

As disclosed in the application, movement of the squeeze plate from its retracted to its wringing position is accomplished manually by grasping the lever arm, sliding it and the squeeze plate forwardly, and then swinging the lever arm to pivot the squeeze plate to wring out the sponge. While this arrangement has been generally satisfactory, it has at times been somewhat inconvenient. This is due at least in part to the fact that the lever arm, being relatively short, extends only a short way up the handle. Thus, in order to grasp it, one must either bend over or lift the mop head a considerable distance off the floor to bring the lever arm within reach.

SUMMARY OF THE INVENTION

Among the several objects of this invention may be noted the provision of of a sponge mop with an improved wringing mechanism; the provision of such a mop wherein the angle through which the wringing mechanism must be pivoted to wring the sponge is minimized; the provision of such a mechanicam wherein a wrining operation may be conveniently effected without undue bending or lifting; and the provision of such a mop in which the wringing mechanism is out of the way when not in use.

Generally, this invention involves a mop comprising a handle, a mop head mounted at one end constituting the front end of the handle for holding a sponge or the like, a wringer for wringing the sponge comprising squeeze means mounted on the mop head for sliding movement from a retracted position in which it is disposed to permit mopping to an extended position, and for pivotal movement about a pivot axis extending in side-to-side direction with respect to the mop head from said extended position to a wringing position in which it squeezes the sponge to wring it, and actuating means comprising a head piece mounted on the handle for movement relative to the handle for effecting said sliding and pivotal movement of the squeeze means.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figures 1, 2, 3:
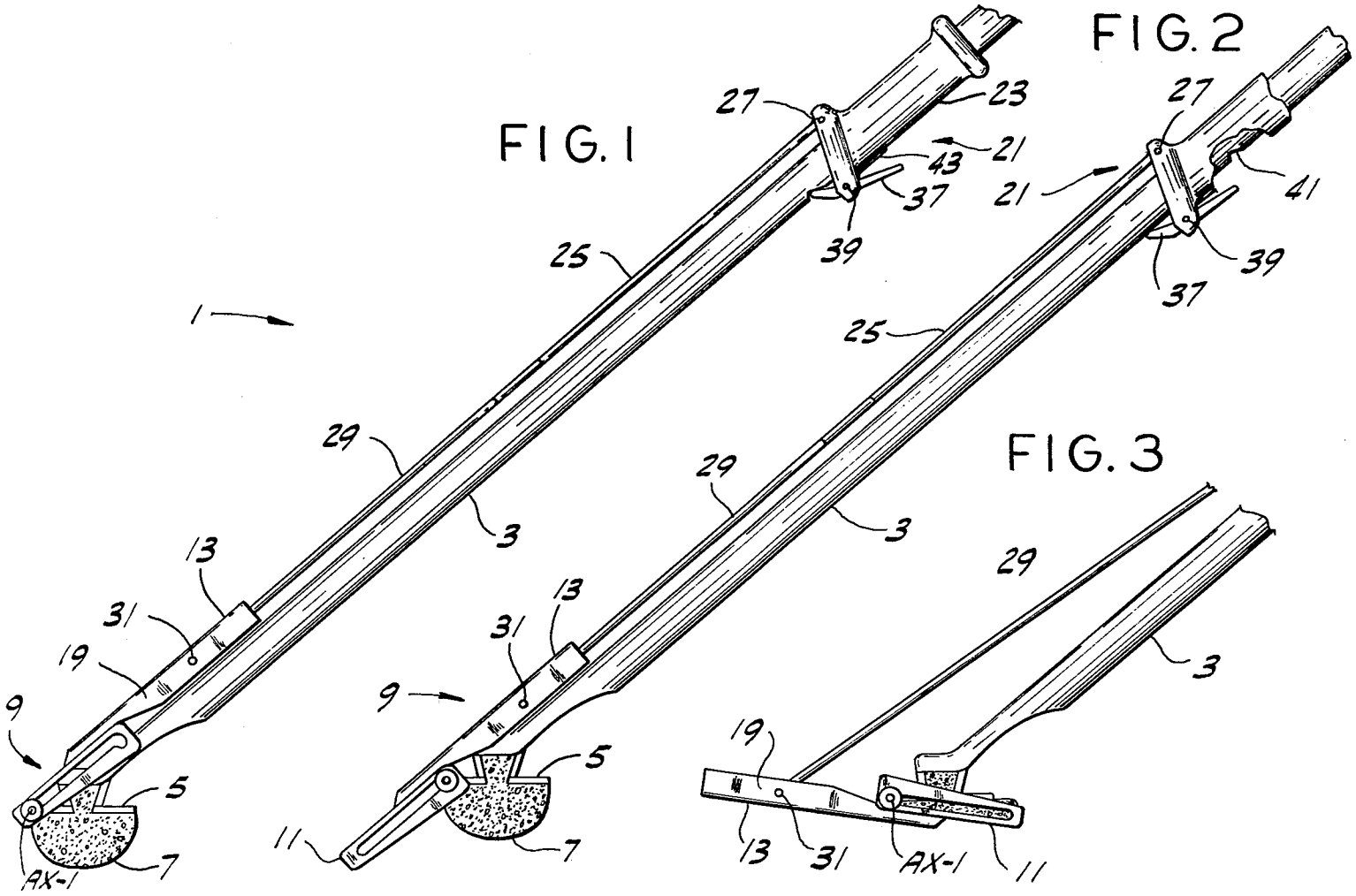
FIG. 1 is a side elevation of a mop with a wringing mechanism incorporating squeeze means of this invention, the squeeze means being shown in a retracted position.
FIG. 2 is a view similar to FIG. 1 showing the squeeze means in an extended position.
FIG. 3 is a partial view in elevation showing the squeeze means in a wringing position.

Referring now to the drawings, and first more particularly to FIG. 1, there is generally indicated at 1 a sponge mop which, except as noted below, is of essentially the same construction as the sponge mop shown and described in my above-mentioned pending application Ser. No. 253,774. The mop generally comprises a handle 3, a mop head 5 at the lower (front) end of the handle holding an ordinary rectangular household sponge 7, and a wringer 9 for wringing the sponge. The wringer includes squeeze means comprising a substantially planar rectangular squeeze plate 11 extending in side-to-side direction with respect to the mop head and a lever arm 13 attached to the squeeze plate and projecting rearwardly therefrom along the handle. The squeeze plate 11 and lever arm 13 are mounted on the mop head for sliding movement from a retracted position (FIG. 1) in which they are disposed to permit mopping, to an extended position (FIG. 2), and for pivotal movement about an axis AX-1 extending in side-to-side direction with respect to the mop head 5 from the stated extended position to a wringing position (FIG. 3) in which the squeeze plate squeezes the sponge 7 to wring it out. Reference may be made to my pending application for a detailed description of the means by which the squeeze plate 11 and lever arm 13 are mounted on the mop head 5 for such sliding and pivotal movement.

The mop thus far described is substantially identical to that shown and described in my pending application, the only difference being that the lever arm 13 shown herein is generally of channel shape, having a web 17 and a pair of generally parallel side flanges 19 extending in generally front-to-back direction with respect to the handle 3.

Figures 4, 5, 6, 7:
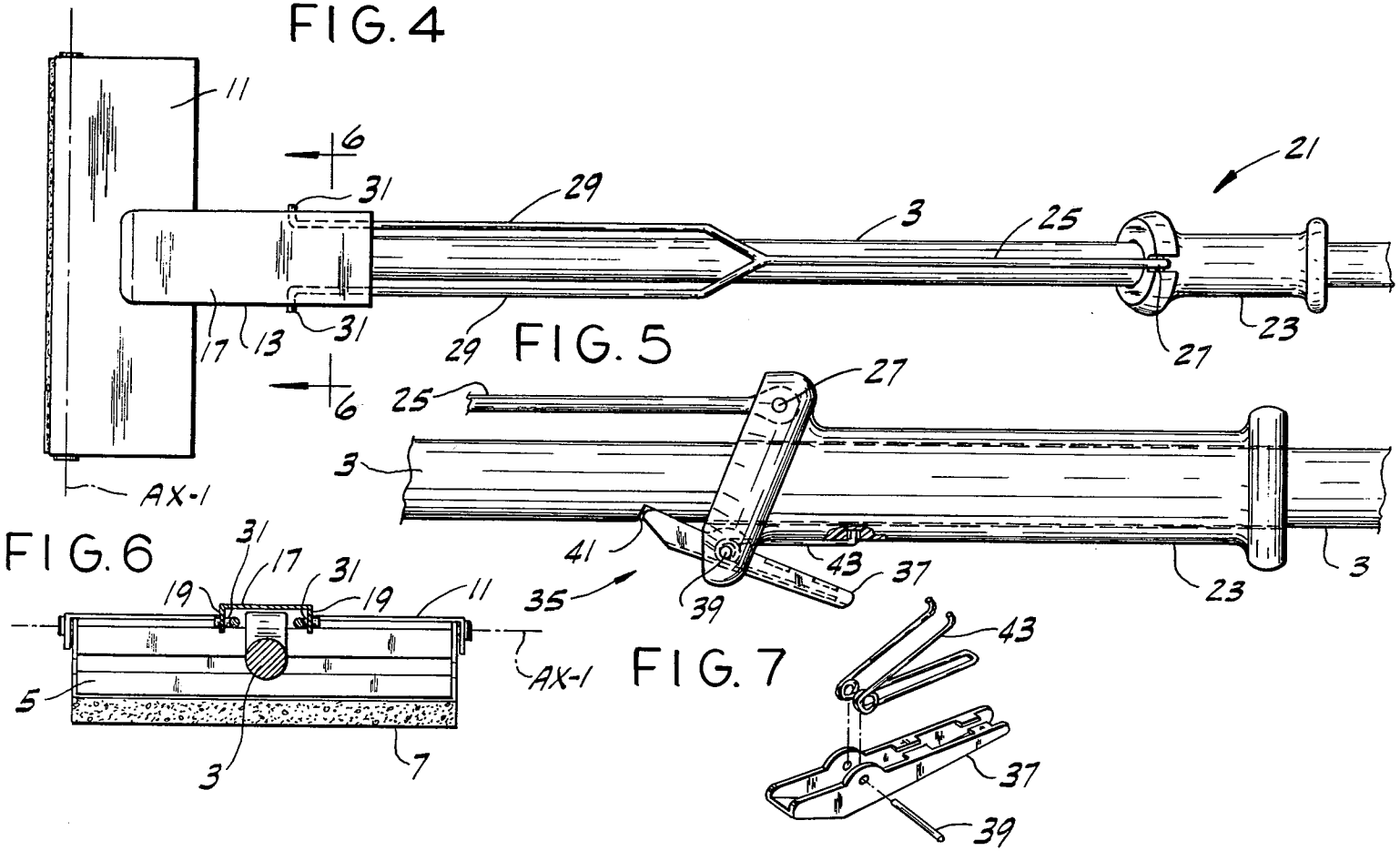
FIG. 4 is a plan of FIG. 1.
FIG. 5 is an enlarged portion of FIG. 1 showing parts of an actuator mechanism for operating the squeeze means.
FIG. 6 is a section on line 6—6 of FIG. 4.
FIG. 7 is an exploded view of a part of the actuator mechanism.

In accordance with the present invention, the wringer 9 further comprises an actuating means or mechanism, generally designated 21, for conveniently effecting a wringing operation, i.e., an operation wherein the lever arm 13 and squeeze plate 11 are slidably moved forward from their retracted position to their extended position, pivoted from the extended position to their wringing position to wring the sponge 7, and then returned back to their retracted position. Specifically, this mechanism includes a tubular hand piece or grip 23 made of suitable material mounted on the handle at a location relatively high up on the handle for convenient manipulation by one using the mop, and means in the form of an actuator rod 25 interconnecting the hand grip and lever arm 13. The rearward (upper) end of this rod has a pin connection 27 with the forward (lower) end of the hand grip 23 for pivotal movement of the rod about an axis extending in side-to-side direction with respect to the handle. The forward (lower) end of the rod 25 is bifurcated into two generally parallel arms, each designated 29, extending in front-to-back direction with respect to the handle. As shown best in FIGS. 4 and 6, the forward portions of these arms extend over the handle 3 along the underside of the web 17 of the lever arm between its side flanges 19 when the squeeze plate 11 is in its retracted position. The forward ends of these arms are bent away from one another generally at right angles to the arms to form pivot fingers 31 which project laterally outwardly through openings in respective side flanges of the lever arm.

The hand grip 23 is slidable along the handle between a rearward position (FIGS. 1 and 5) and a forward position (not shown) for operating the actuating mechanism 21. Thus, sliding the handle forwardly from its FIG. 1 position causes the actuator rod to push the lever arm 13 and squeeze plate 11 forwardly from their retracted position to their extended position (FIG. 2), and then to pivot the lever arm and squeeze plate about axis AX-1 from their extended position to their wringing position (FIG. 3). As the lever arm and squeeze plate swing to this latter position the lever arm pivots on the pivot fingers 31 and the rearward end of the actuator rod pivots on the hand grip about pin connection 27. The squeeze plate and lever arm may be returned to their retracted position to permit mopping by sliding the hand grip rearwardly on the handle back to its original (rearward) position.

Indicated generally at 35 is means for releasably securing the hand grip in its rearward position thereby to lock the squeeze plate and lever arm in their stated retracted position. Means 35 comprises a locking lever or trigger 37 pinned at 39 to the forward end of the hand grip on the underside of the handle for pivotal movement about an axis extending from side-to-side with respect to the handle between a locking position (FIGS. 1 and 5) in which the front (left) end of the trigger is received in a recess in the form of a notch 41 in the handle 3 to prevent the hand grip from being moved forwardly along the handle, and a release position (FIG. 2) in which the front end of the trigger is removed from the notch so that the hand grip may be moved forwardly to operate the actuator mechanism 21. A double-arm grasshopper spring 43 constitutes means for biasing the trigger 37 toward its locking position. When the trigger is in this latter position its back end is positioned for convenient engagement by the index finger of the hand grasping the hand grip.

It will be observed that since the hand grip is mounted relatively far from the mop head 5, i.e., relatively high up on the handle 3, it is in a position in which it may readily be grasped for operating the actuating mechanism 21 without undue bending over and without having to lift the mop head 5 a substantial distance off the floor. This of course greatly facilitates the mopping process.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A mop comprising a handle, a mop head mounted at one end constituting the front end of the handle for holding a sponge or the like, a wringer for wringing the sponge comprising squeeze means mounted on the mop head for sliding movement from a retracted position in which it is disposed to permit mopping to an extended position, and for pivotal movement about a pivot axis extending in side-to-side direction with respect to the mop head from said extended position to a wringing position in which it squeezes the sponge to wring it, and actuating means comprising a hand piece mounted on the handle for movement along the handle for effecting said sliding and pivotal movement of the squeeze means.

2. A mop as set forth in claim 1 wherein said hand piece is mounted relatively far from the front end of the handle for enabling ready manipulation of the hand piece as the mop is being used.

3. A mop as set forth in claim 1 wherein said actuating means further comprises means interconnecting the hand piece and said squeeze means, said hand piece being slidable forwardly along the handle toward the mop head from a rearward position to a forward position for effecting, via said interconnecting means, said sliding and pivotal movement of the squeeze means from said retracted position to said wringing position, and from said forward position back to said rearward position for effecting, via said interconnecting means, the return of said squeeze means back to said retracted position.

4. A mop as set forth in claim 3 further comprising means for releasably securing said hand piece in said rearward position.

5. A mop as set forth in claim 4 wherein said securing means comprises a locking lever mounted on said hand piece for pivotal movement between a locking position in which it is engageable with the handle for securing said hand piece in said rearward position, and a release position in which the hand piece may be moved forwardly.

6. A mop as set forth in claim 5 wherein said locking lever is spring-biased toward its locking position.

7. A mop as set forth in claim 5 wherein said handle has a recess therein, one end of said locking lever being receivable in said recess when the lever is in its said locking position thereby to prevent the hand piece from being moved forwardly along the handle.

8. A mop as set forth in claim 3 wherein said squeeze means comprises a squeeze plate extending in side-to-side direction with respect to the head, and a lever arm projecting generally rearwardly from the squeeze plate along the mop handle when the wringer is in said retracted position.

9. A mop as set forth in claim 8 wherein said interconnecting means comprises an actuator rod extending forwardly along the mop handle from the hand piece to the lever arm, the forward end of said actuator rod having a pivot connection with the lever arm whereby on sliding the handpiece forwardly from said rearward to said forward position said actuator rod is adapted to push the lever arm and the squeeze plate from said retracted position to said extended position and then to pivot the lever arm and squeeze plate about said pivot axis from said extended position to said wringing position, the lever arm pivoting on the actuator rod as the squeeze plate and lever arm pivot from said extended position to said wringing position.

10. A mop as set forth in claim 9 wherein said lever arm is generally of channel shape, comprising a web and a pair of side flanges extending generally in front-to-back direction with respect to the handle, the forward end of said actuator rod being bifurcated into two generally parallel arms also extending in front-to-back direction, each arm having a pivot connection with a respective flange of said lever arm.

11. A mop as set forth in claim 10 wherein the forward ends of said actuator arms are bent away from one another and received in openings in respective flanges of the lever arm.

12. A mop as set forth in claim 1 wherein said hand piece comprises a tubular hand grip slidable on the mop handle.

* * * * *